US006247993B1

(12) United States Patent
Feldman

(10) Patent No.: US 6,247,993 B1
(45) Date of Patent: Jun. 19, 2001

(54) JUMPROPE SIMULATING DOLL

(75) Inventor: Joseph Feldman, Los Angeles, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/366,172

(22) Filed: Aug. 3, 1999

(51) Int. Cl.[7] ..... A63H 13/14
(52) U.S. Cl. ..... 446/307; 446/309
(58) Field of Search ..... 446/307, 308, 446/309, 311, 312, 484

(56) References Cited

U.S. PATENT DOCUMENTS

| | | | | |
|---|---|---|---|---|
| 1,331,378 | * | 2/1920 | Roberts | 446/307 |
| 1,594,649 | | 8/1926 | Trautmann . | |
| 3,603,030 | * | 9/1971 | Bart et al. | 446/307 |
| 3,650,066 | * | 3/1972 | Amici et al. | 446/307 |
| 3,744,182 | * | 7/1973 | Terzian et al. | 446/307 |
| 4,608,026 | | 8/1986 | Newton et al. . | |
| 4,618,330 | | 10/1986 | Abe . | |
| 5,087,219 | | 2/1992 | Price . | |
| 5,376,039 | * | 12/1994 | Balgin | 446/307 |

* cited by examiner

*Primary Examiner*—Sam Rimell
(74) *Attorney, Agent, or Firm*—Roy A. Ekstrand

(57) ABSTRACT

A doll includes a torso slidingly supported upon the waist of the doll and configured for vertical movement between a raised and lowered position. A pair of springs bias the doll torso toward the raised position. The doll supports a pair of arms and a cam in a rotational attachment to the torso. A pedestal supported upon the doll lower body extends through a guiding bore formed in the doll torso and supports an upwardly extending pin which operates the cam causing pivotal movement of the dolls arms between an arms-lowered and arms-raised position. A flexible jumprope is secured to the dolls hands and the upward and downward pivotal movement of the dolls arms caused by movement of the torso provides a simulation of jumprope activity.

5 Claims, 3 Drawing Sheets

JUMPROPE SIMULATING DOLL

FIELD OF THE INVENTION

This invention relates generally to dolls and particularly to those which include apparatus for manipulating the dolls appendages to mimic certain human-like activities.

BACKGROUND OF THE INVENTION

Dolls which perform activities are well known in the art and have been provided for many years. The activities performed by such dolls are virtually endless in variety and have included virtually all human activities including walking, talking, eating, sleeping, crawling, skating, swimming and the playing of various sports and activities. The mechanisms provided within such activity performing dolls have been equally varied through the years as practitioners have sought to perfect the activity doll. Thus, dolls have been provided which include battery-power sources and electric motors operating various limb movement apparatus. Earlier dolls utilized movement apparatus which was spring powered by wind-up motors. Still other activity dolls have been provided which utilize a manual or hand powered activity. Such hand powered activity dolls are characterized generally by having articulated parts such as limbs or appendages together with an internal movement mechanism which drives the activity feature.

Among the various types of dolls which are well known in the art, perhaps the most challenging type of doll which is adapted for performing various activities is found in the type of dolls known generally as "fashion dolls". Fashion dolls are generally described as relatively small and slender dolls having hard molded plastic bodies and articulated arms, legs and head. The small size of such types of dolls render the process of fitting an internal drive mechanism suitable for activity performance within the limited space of the doll body difficult if not some times impossible.

In the face of the continued popularity and consumer appeal of activity type dolls, practitioners in the art have provided various improved dolls and apparatus therefore. For example, U.S. Pat. No. 3,603,030 issued to Bart et al. sets forth a JUMPING TOY which is capable of jumping rope. The rope jumping is accomplished by providing a doll body capable of sliding up and down upon its legs and having an internal spring and drive apparatus. The internal spring provides energy for the drive apparatus which in turn is coupled to a synchronized movement mechanism which rotates the dolls arms and passes a jump rope beneath the dolls feet as the feet are snapped upwardly into the doll body.

U.S. Pat. No. 5,376,039 issued to Balgin sets forth a ROPE-SKIPPING TOY which closely imitates rope jumping by a human. A battery-powered motor is activated and deactivated by lightly pressing on the top of the dolls head. Once in motion, the doll appears to swirl the rope overhead and underfoot while effecting a jump each time the rope passes beneath the dolls feet.

U.S. Pat. No. 5,087,219 issued to Price sets forth an ACTION CHARACTER FIGURE having a torso, a rotatable arm supported on the torso and a leg portion which is retractable into the lower end of the torso. The arm is connected to the leg within the interior of the torso such that rotation of the arm causes the leg to be retracted into the torso against a biasing spring. Releasing the arm causes a reverse action and a jumping action.

U.S. Pat. No. 4,608,026 issued to Newton et al. sets forth an FIGURE WHEREIN MANIPULATION OF ONE LIMB CAUSES MOTION OF ANOTHER having a toy figure in which a pivotally supporting leg operates an internal drive mechanism within the doll torso. The drive mechanism in turn causes a pivotal movement of one of the doll arms.

U.S. Pat. No. 3,744,182 issued to Terzian et al. sets forth a SELF-PROPELLED TOY having a toy figure supporting a movable weight mass within the body interior. The weight mass is operated to be moved rapidly between first and second positions to induce a vertical jumping movement of the toy. A rotatable arm pair supports a jump rope which is passed beneath the doll feet as the doll is moved vertically.

U.S. Pat. No. 1,331,378 issued to Roberts sets forth a DOLL having a base supporting a vertical member upon which a wind up motor drive is further supported. The motor drive is coupled to a horizontally extending shaft which in turn is coupled to the shoulders of a toy figure. The toy figure includes a jump rope which is rotated as the wind up mechanism rotates the doll arms and periodically lifts the toy vertically.

U.S. Pat. No. 1,594,649 issued to Trautmann sets forth an SKIPPING TOY having a doll within which a fly wheel is rotatably supported. The fly wheel provides a source of rotational power when rotated by a pull-string which in turn is used to move the doll arms in a simulated rope jumping action.

U.S. Pat. No. 4,618,330 issued to Abe sets forth a TOY AMUSEMENT DEVICE having a housing supporting a plurality of rotatable members.

While the foregoing described prior art devices have improved the art and in some instances enjoyed commercial success, there remains nonetheless a continuing need in the art for ever more improved, interesting and amusing activity dolls.

SUMMARY OF THE INVENTION

Accordingly, it is a general object of the present invention to provided an improved activity doll. It is a more particular object of the present invention to provide an improved activity doll which simulates jump rope activity. It is a still more particular object of the present invention to provide an improved activity performing doll which simulates jump rope activity and which utilizes a mechanism and play pattern suitable for use in fashion dolls or the like.

In accordance with the present invention there is provided a doll simulating a jumprope action, the doll comprising: a doll body having a torso, a waist and means for supporting the torso upon the waist moveable between a raised and a lowered position; a pair of arms pivotally secured to the torso; cam means, operative in response to movement of the torso, for pivoting the arms between an arms-lowered and an arms-raised position; and a jumprope coupled to the arms, the torso being rapidly moved between the raised and lowered position to rapidly pivot the arms between the arms-raised and arms-lowered positions and move the jumprope.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
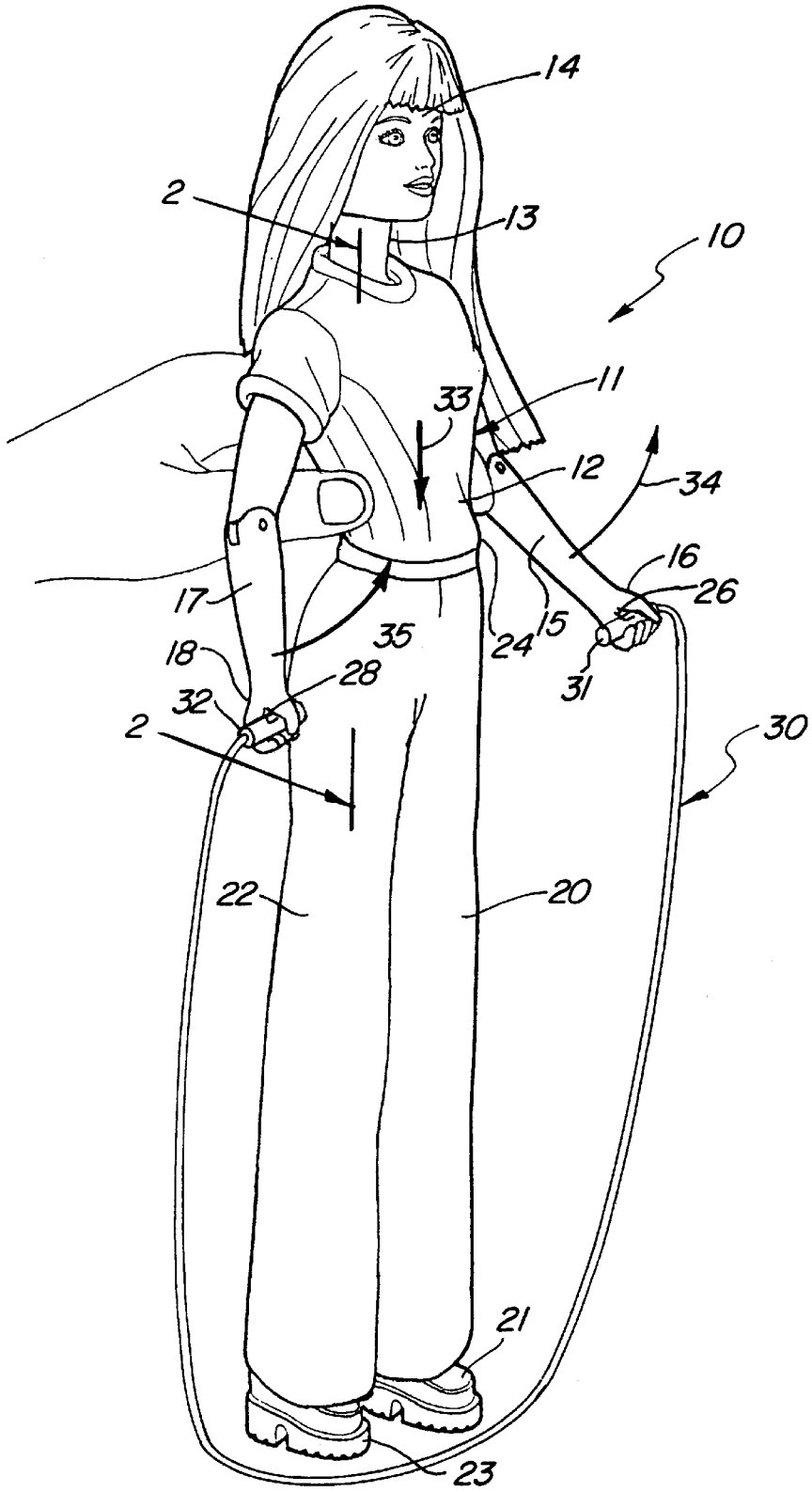
FIG. 1 sets forth a perspective view of a doll constructed in accordance with the present invention.

FIG. 1 sets forth a perspective view of a jumprope simulating doll constructed in accordance with the present invention and generally referenced by numeral 10. Doll 10 is configured to generally resemble a young girl or women and is a type of doll which may generally be described as a "fashion doll". Doll 10 includes a body 11 fabricated of a relatively rigid material such as molded plastic or the like and defining a torso 12, a waist 24 and a pair of legs 20 and 22. A pair of feet 21 and 23 are joined to the body ends of legs 20 and 22. Torso 12 further defines a neck 13 which supports a head 14. The structure of neck 13 and head 14 together with the structure of legs 20 and 22 may be carried forward using conventional fabrication techniques.

Body 11 further includes a pair of arms 15 and 17 which are pivotally secured to torso 12 in the manner set forth below in FIGS. 2 through 5. Suffice it to note here, that arms 15 and 17 defines respective hands 16 and 18 and are pivotally joined to the shoulder portions of torso 12.

In accordance with the present invention, doll 10 further includes a jumprope 30 preferably formed of a some what flexible cord or line having a pair of handles 31 and 32 at the ends thereof. Handles 31 and 32 are received within hands 16 and 18 which define respective passages 26 and 28 therein. Passages 26 and 28 are configured and sized to receive handles 31 and 32 in a firm snug fit such that jumprope 30 remains held by hands 16 and 18 in the manner shown in FIG. 1.

Doll 10 further includes an outer garment 19 formed of a flexible fabric material which substantially covers torso 12, waist 24 and legs 20 and 22. Garment 19 is sufficiently flexible and loose to allow the movement of torso 12 described below toward and away from waist 24 in the operative action of the present invention doll.

Figure 2:
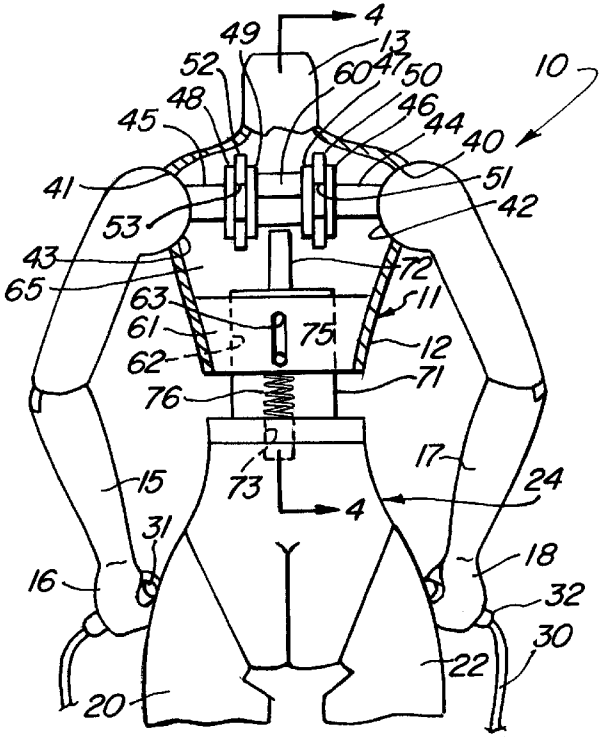
FIG. 2 sets forth a partially sectioned rear view of the present invention doll taken along section lines 2—2 in FIG. 1 having the arms in a lowered position.

In operation, torso 12 is shown in FIG. 1 in its relaxed position in which no force is applied to body 11 and in which torso 12 is extended to the position shown in FIG. 2. In this extended position by means set forth below in FIGS. 2 through 5, torso 12 and the operative mechanism within body 11 described below position arms 15 and 17 in the downwardly extending position shown in FIG. 1. To operate the play activity of the present invention doll, the user grasps torso 12 in a convenient manner and forces torso 12 downwardly toward waist 24 in the direction indicated by arrow 33. By means set forth below in greater detail, the downward force upon torso 12 moves torso 12 downwardly in the direction indicated by arrow 33 toward waist 24. Correspondingly, the downward motion of torso 12 operates in the manner set forth below in FIGS. 2 through 5 to pivot arms 15 and 17 upwardly in the directions indicated by arrows 34 and 35 to the arms-raised position shown in FIG. 3.

As the user then releases torso 12, the return springs (springs 76 and 78 in FIG. 4) operative upon torso 12 force torso 12 upwardly returning torso 12 to the position shown in FIG. 1. Concurrently, the return travel of torso 12 operates in the manner set forth below in FIGS. 2 through 5 to pivot arms 15 and 17 downwardly from the arms-raised position of FIG. 3 to the arms-lowered position of FIG. 1. As the user becomes skillful in timing the downward force and release upon torso 12 and the movement of torso 12 caused by such downward force and release, the movement of arms 15 and 17 between the hands lowered position and hands raised position on a repeated basis causes jumprope 30 to appear to undergo a jumprope play pattern motion. In truth, jumprope 30 does not undergo an actual jumprope action and does not pass above head 14 and beneath feet 21 and 23. Instead, jumprope 30 moves up and down in a swinging motion in front of doll 10 thereby simulating a jumprope action. It has been found children become very skilled at manipulating the present invention doll and imparting a "jumping" action to the doll as they force torso 12 down and release or raise torso 12 and thereby produce a very good simulation of jumprope action.

FIG. 2 sets forth a partial section rear view of doll 10 taken along section lines 2—2 in FIG. 1. By way of overview, it will noted that the section view of FIG. 2 shows the operative mechanism of doll 10 in a relaxed or natural position in which the doll torso is positioned in its upward position and in which the doll arms are extended downwardly in the arms down position.

More specifically, doll 10 includes a body 11 preferably formed of molded plastic components or the like and having a torso 12 defining an interior cavity 65 and supporting a wall 61 therein. Wall 61 defines a center bore 62 and an elongated vertical slot 63. Torso 12 further includes a pair of shoulder sockets 40 and 41 and a neck 13. As described above, neck 13 supports a head 14 (seen in FIG. 1) in accordance with conventional fabrication techniques. Torso 12 further includes a pair of plates 50 and 52 defining respective notches 51 and 53.

Doll 10 further includes a pair of arms 15 and 17 having respective ball ends 43 and 42 which are received within sockets 41 and 40 respectively. Arm 15 includes a hand 16 which receives handle 31 of jumprope 30 while arm 17 defines a hand 18 which receives a handle 32 of jumprope 30. Arm 15 further includes a shaft 45 extending inwardly from ball end 43 which extends through notch 53 of plate 52. A pair of flanges 48 and 49 are supported upon shaft 45 on each side of plate 52. Similarly, arm 17 includes a shaft 44 extending inwardly from ball end 42 and received within notch 51. Shaft 44 supports a pair of flanges 46 and 47 on either side of plate 50. Shaft 44 and shaft 45 are mutually joined to a triangularly shaped cam 60 extending between flanges 47 and 49. In the preferred fabrication of the present invention, shafts 44 and 45 together with cam 60 and flanges 46, 47, 48 and 49 are fabricated as a single integrally formed unit. Further in accordance with the preferred fabrication of the present invention, shaft 44 is securely joined to ball end 42 while shaft 45 is secured joined to ball end 43. As a result, the combined structure of arms 15 and 17 together with shafts 44 and 45 and cam 60 are rotated as a single rotational unit.

Body 11 further includes a waist 24 supported upon a pair of legs 20 and 22. A base 70 includes a cylindrical pedestal 71 extending upwardly through bore 62 and fitted within bore 62 to allow free sliding movement thereon. Pedestal 71 further includes a pin 75 extending outwardly from pedestal 71 which is received within slot 63. Slot 63 and pin 75 cooperate to provide a travel limit for relative movement between pedestal 71 and torso 72.

Pedestal 71 further includes an upwardly extending pin 72. A spring 76 is received within a bore 73 formed in body 11 at waist 24. Spring 76 extends upwardly from bore 73 beyond base 70 and is captivated against the lower edge of wall 61. As is better seen in FIG. 4, waist 24 of body 11 further defines a bore 77 supporting a spring 78 which is also captivated against the underside of wall 61.

In the relaxed position shown in FIG. 2 in which no force is applied to torso 12, the force of springs 76 and 78 (spring 78 seen in FIG. 4) supports torso 12 together with arms 15 and 17 and jumprope 30 in the raised position shown in FIG. 2. The upward movement of torso 12 due to springs 76 and 78 (spring 78 seen in FIG. 4) is limited by the travel of pin 75 of pedestal 71 within slot 63. As can be seen, the upward spring force against wall 61 forces wall 61 upwardly until the lower end of slot 63 contacts pin 75 of pedestal 71. As will also be noted, pin 72 is free of contact with cam 60 and thus no force is communicated between pin 72 and cam 60. The rotational support of arms 15 and 17 provided by shafts 45 and 44 within notches 53 and 51 of plates 52 and 50 respectively is a freely moveable support allowing arms 15 and 17 to pivot downwardly under their own weight to the arms-lowered position shown in FIG. 2.

Figure 3:
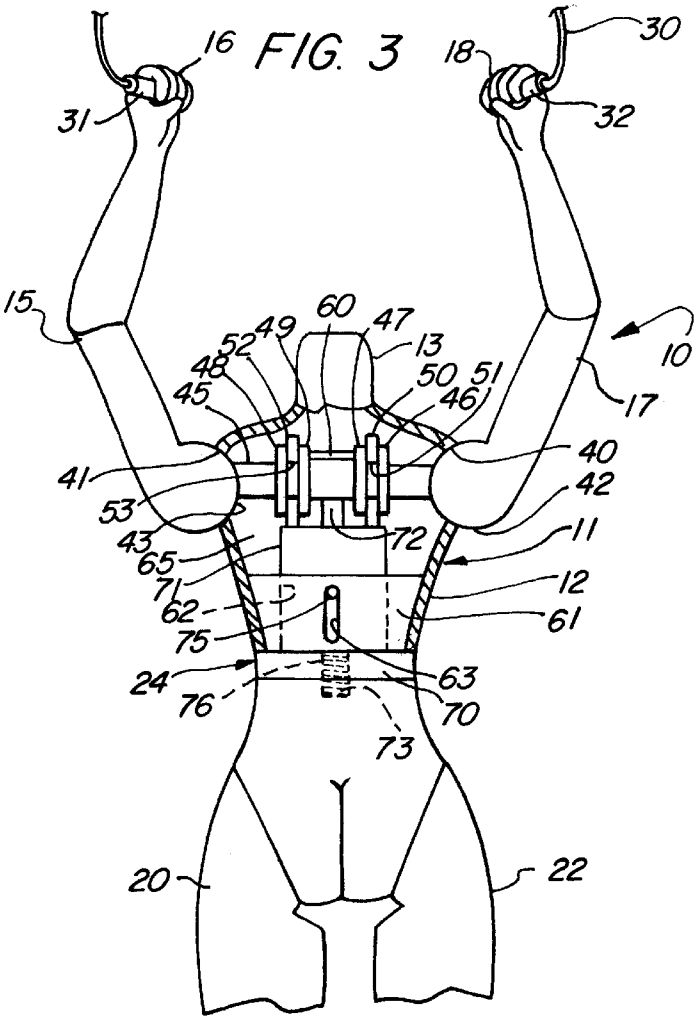
FIG. 3 sets forth a partially sectioned rear view of the present invention doll taken along section lines 2—2 in FIG. 1 showing the dolls arms in a raised position.

FIG. 3 sets forth the section view of FIG. 2 in which torso 12 has been forced downwardly upon waist 24 moving the present invention doll to its arms-raised position.

More specifically, doll 10 includes a body 11 preferably formed of molded plastic components or the like and having a torso 12 defining an interior cavity 65 and supporting a wall 61 therein. Wall 61 defines a center bore 62 and an elongated vertical slot 63. Torso 12 further includes a pair of shoulder sockets 40 and 41 and a neck 13. As described above, neck 13 supports a head 14 (seen in FIG. 1) in accordance with conventional fabrication techniques. Torso 12 further includes a pair of plates 50 and 52 defining respective notches 51 and 53.

Doll 10 further includes a pair of arms 15 and 17 having respective ball ends 43 and 42 which are received within sockets 41 and 40 respectively. Arm 15 includes a hand 16 which receives handle 31 of jumprope 30 while arm 17 defines a hand 18 which receives a handle 32 of jumprope 30. Arm 15 further includes a shaft 45 extending inwardly from ball end 43 which extends through notch 53 of plate 52. A pair of flanges 48 and 49 are supported upon shaft 45 on each side of plate 52. Similarly, arm 17 includes a shaft 44 extending inwardly from ball end 42 and received within notch 51. Shaft 44 supports a pair of flanges 46 and 47 on either side of plate 50. Shaft 44 and shaft 45 are mutually joined to a triangularly shaped cam 60 extending between flanges 47 and 49. In the preferred fabrication of the present invention, shafts 44 and 45 together with cam 60 and flanges 46, 47, 48 and 49 are fabricated as a single integrally formed unit. Further in accordance with the preferred fabrication of the present invention, shaft 44 is securely joined to ball end 42 while shaft 45 is secured joined to ball end 43. As a result, the combined structure of arms 15 and 17 together with shafts 44 and 45 and cam 60 are rotated as a single rotational unit.

Body 11 further includes a waist 24 supported upon a pair of legs 20 and 22. A base 70 includes a cylindrical pedestal 71 extending upwardly through bore 62 and fitted within bore 62 to allow free sliding movement thereon. Pedestal 71 further includes a pin 75 extending outwardly from pedestal 71 which is received within slot 63. Slot 63 and pin 75 cooperate to provide a travel limit for relative movement between pedestal 71 and torso 72.

Pedestal 71 further includes an upwardly extending pin 72. A spring 76 is received within a bore 73 formed in body 11 at waist 24. Spring 76 extends upwardly from bore 73 beyond base 70 and is captivated against the lower edge of wall 61. As is better seen in FIG. 4, waist 24 of body 11 further defines a bore 77 supporting a spring 78 which is also captivated against the underside of wall 61.

Figure 4:
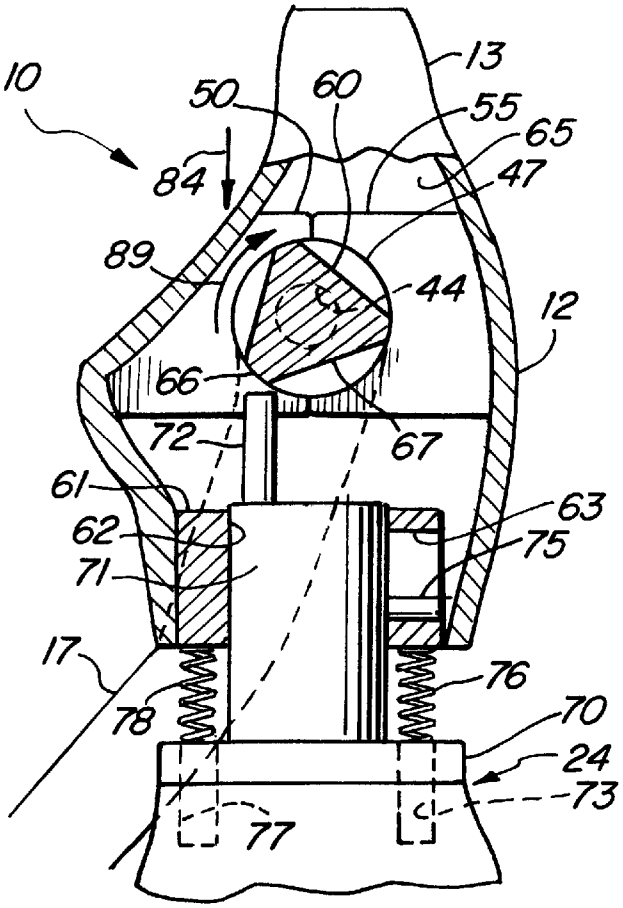
FIG. 4 sets forth a partially sectioned side view of the present invention doll in an arms-lowered position.

With temporary return to FIG. 2, it will be recalled that torso 12 is supported above base 70 by springs 76 and 78 (spring 78 seen in FIG. 4). It will be further recalled, in this position pin 72 is out of contact with cam 60 and as a result arms 15 and 17 are pivoted under their own weight to the arms down position shown in FIG. 2.

Returning to FIG. 3, torso 72 has been forced downwardly overcoming the force of springs 76 and 78 (spring 78 seen in FIG. 4) and forcing wall 61 downwardly upon pedestal 71. This downward movement is limited by the travel of pin 75 within slot 63 of wall 61. As torso 12 is moved downwardly, the combined structure of shafts 44 and 45 and cam 60 is forced downwardly such that cam 60 is forced against pin 72. In the manner set forth below in FIGS. 4 and 5 in greater detail, the force of pin 72 against cam 60 rotates cam 60 and thereby shafts 44 and 45 which in turn pivots arms 17 and 15 respectively to the arms-raised position shown in FIG. 3. In further accordance with the present invention, as arms 15 and 17 rapidly pivot upwardly jumprope 30 is caused to swing forwardly and upwardly to extend above hands 16 and 18. Once torso 12 has been released, the force of springs 76 and 78 (spring 78 seen in FIG. 4) raise torso 72 to the position shown in FIG. 2 which in turn allows arms 15 and 17 to pivot downwardly to the arms-lowered position shown in FIG. 2. The downward pivotal movement of arms 15 and 17 swings jumprope 30 downwardly in front of doll 10 returning jumprope 30 to the position shown in FIG. 1. As the user acquires skill in timing the successive downward force and release of torso 12 the user is able to manipulate arms 15 and 17 in a manner producing a swinging movement of jumprope 30 up and down in front of doll 10 to simulate a realistic jumprope action.

FIG. 4 sets forth a partial section view of doll 10 taken along section lines 4—4 in FIG. 2. FIG. 4 sets forth the configuration of doll 10 in the relaxed position corresponding to the configuration shown in FIG. 2 in which no force is applied to the doll torso and in which the doll torso is positioned by springs 76 and 78. Thus, the configuration shown in FIG. 4 corresponds to the relaxed or arms-lowered configuration of doll 10.

More specifically, doll 10 includes a body 11 having a torso 12 defining an interior cavity 65 and supporting a neck 13. Torso 12 further includes a wall 61 secured to torso 12 and defining a bore 62 therein. Wall 61 further defines a slot 63 and an upwardly extending pin 72. Body 11 further includes a waist 24 and a base 70 defining a pair of bores 73 and 77 therein. Bore 73 receives a spring 76 while bore 77 receives a spring 78. Springs 76 and 78 are captivated against the undersurface of wall 61. Base 70 supports an upwardly extending generally cylindrical pedestal 71 slidingly received within bore 62 and supporting an upwardly extending pin 72. Pedestal 71 further supports a rearwardly extending pin 75 received within slot 63 of wall 61.

Torso 12 further includes a pair of plates 50 and 55 extending into interior cavity 65. In the manner shown in FIG. 2, a shaft 44 which supports an arm 17 is rotatably supported between plates 50 and 55. Shaft 44 further supports a flange 47 which in turn supports a triangularly shaped cam 60. Cam 60 defines an apex 66 and a flat 67. As mentioned above, cam 60 is rotatable with arms 15 and 17 (arm 15 seen in FIG. 2).

In the position shown in FIG. 4 and in the absence of a downward force upon torso 12, cam 60 is raised above pin 72 allowing arms 15 and 17 (arm 15 seen in FIG. 2) to rest in the arms-lowered position shown. It will be noted that the upper end of pin 72 is generally aligned with the underside of apex 66 of cam 60. Thus, as the user forces torso 12 downwardly in the direction indicated by arrow 84 overcoming the force of springs 76 and 78 cam 60 is forced downwardly toward pin 72. As cam 60 moves downwardly apex 66 is brought into contact with the upper end of pin 72. As torso 12 continues to be moved downwardly forcing apex 66 of cam 60 against pin 72 causing cam 60 to be rotated in the direction indicated by arrow 89. The rotation of cam 60 in turn rotates shafts 44 and 45 (shafts 44 and 45 seen in FIG. 2) which in turn pivots arms 15 and 17 (arm 15 seen in FIG. 2) upwardly. As the force applied to torso 12 continues, torso 12 is moved to the fully lowered position shown in FIG. 5 and arms 15 and 17 (arm 15 seen in FIG. 2) are raised to the arms-raised position also shown in FIG. 5. The downward movement of torso 12 is limited by the travel of pin 75 within slot 63.

Figure 5:
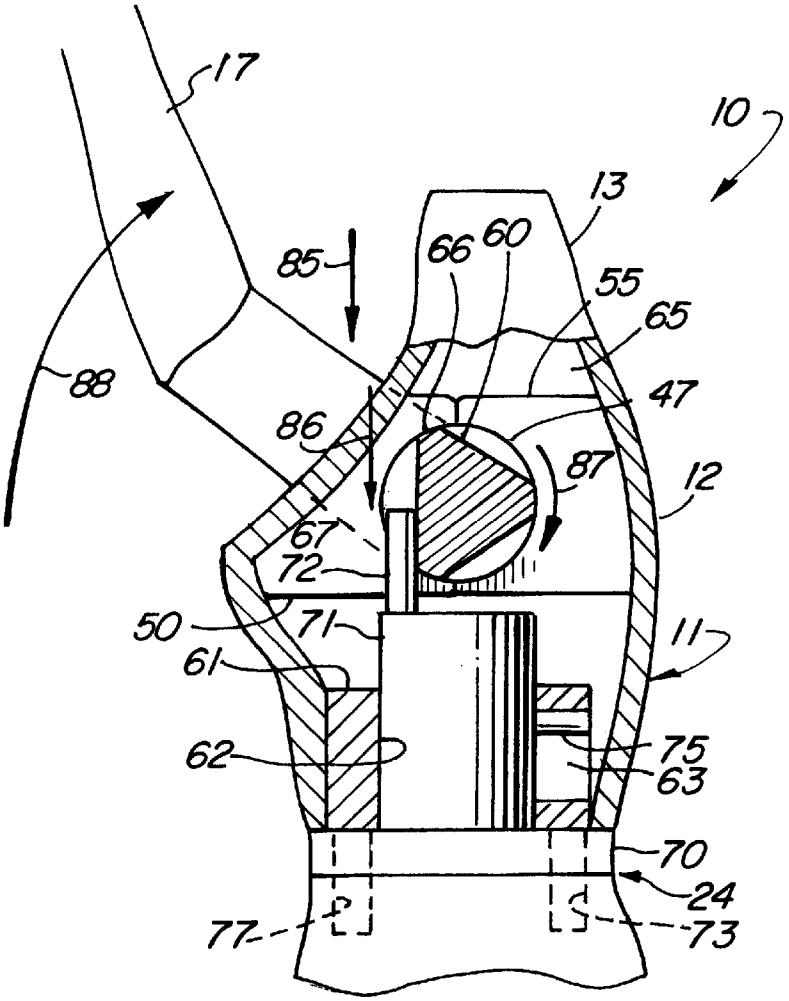
FIG. 5 sets forth a partially sectioned side view of the present invention doll in an arms-raised position.

FIG. 5 sets forth the section view of FIG. 4 in which doll 10 is shown in its arms-raised configuration which results from the fully downward movement of torso 12.

More specifically, doll 10 includes a body 11 having a torso 12 defining an interior cavity 65 and supporting a neck 13. Torso 12 further includes a wall 61 secured to torso 12 and defining a bore 62 therein. Wall 61 further defines a slot 63 and an upwardly extending pin 72. Body 11 further includes a waist 24 and a base 70 defining a pair of bores 73 and 77 therein. Bore 73 receives a spring 76 while bore 77 receives a spring 78. Springs 76 and 78 are captivated against the undersurface of wall 61. Base 70 supports an upwardly extending generally cylindrical pedestal 71 slidingly received within bore 62 and supporting an upwardly extending pin 72. Pedestal 71 further supports a rearwardly extending pin 75 received within slot 63 of wall 61.

Torso 12 further includes a pair of plates 50 and 55 extending into interior cavity 65. In the manner shown in FIG. 2, a shaft 44 which supports an arm 17 is rotatably supported between plates 50 and 55. Shaft 44 further supports a flange 47 which in turn supports a triangularly shaped cam 60. Cam 60 defines an apex 66 and a flat 67. As mentioned above, cam 60 is rotatable with arms 15 and 17 (arm 15 seen in FIG. 2).

As torso 12 is forced downwardly causing rotation of cam 60, pin 72 is moved upon flat surface 67 of cam 60. Thus, the downward force upon torso 12 in the direction indicated by arrow 85 moves cam 60 downwardly against pin 72 rotating cam 60 in the direction indicated by arrow 87. Correspondingly, arms 15 and 17 (arm 15 seen in FIG. 2) are pivoted upwardly in the direction indicated by arrow 88. Springs 76 and 78 (seen in FIG. 4) are fully compressed within bores 73 and 77 when torso 12 reaches its full downward travel. Thereafter, the user releases torso 12 allowing springs 76 and 78 (seen in FIG. 4) to raise torso 12 upwardly to the position shown in FIG. 4 which releases the engagement of pin 72 against cam 60 allowing arms 15 and 17 (arm 15 seen in FIG. 2) to pivot downwardly to the arms-lowered position.

Thus, as the user rapidly forces torso 12 downwardly and releases torso 12, the dolls arms are rapidly pivoted between the arms-lowered and arms-raised position resulting in the above described simulation of jumprope action.

What has been shown is a novel jumprope simulating doll in which a relatively simple operative mechanism is provided in a manner easy for even the youngest of children to master. Despite the simplicity of the novel mechanism of the present invention doll, a realistic simulation of jumprope movement and action is provided in which the complexity involved in simulations here to fore provided of jumprope action which accompany attempts to pass the jumprope over the dolls head, behind the doll body and beneath the dolls feet during each operative cycle are avoided. Instead the present invention doll utilizes a simple raising and lowering motion to impart a jumprope simulation to the doll.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll constructed to be held by a user and operative in response to user manipulation of said doll to cause said doll to a jumprope action, said doll comprising:

a doll body having a torso, a waist and means for supporting said torso upon said waist moveable between a raised and a lowered position;

a pair of arms pivotally secured to said torso;

cam means, coupled to said pair of arms, operative in response to movement of said torso caused by user manipulation of said torso between said raised and lowered position, for pivoting said arms between an arms-lowered and an arms-raised position; and a jumprope coupled to said arms, said torso being rapidly moved between said raised and lowered position by user manipulation to rapidly pivot said arms between said arms-raised and arms-lowered positions and move said jumprope up and down in front of said doll.

2. The doll set forth in claim 1 wherein said means for supporting said torso includes spring means for biasing said torso toward said raised position.

3. The doll set forth in claim 2 wherein said means for supporting said torso includes:

a pedestal supported by said waist; and a wall supported by said torso having a bore therein receiving said pedestal in a vertically sliding attachment.

4. The doll set forth in claim 3 wherein said cam means includes:

a cam joined to said pair of arms; and a pin extending from said pedestal engaging and rotating said cam to pivot said pair of arms when said torso is raised and lowered.

5. The doll set forth in claim 4 wherein said pair of arms each include a hand having a passage therein and wherein said jumprope includes a pair of handles received within said passages.

* * * * *